US006598569B2

(12) United States Patent
Takemura et al.

(10) Patent No.: US 6,598,569 B2
(45) Date of Patent: Jul. 29, 2003

(54) VARIABLE VALVE TIMING DEVICE OF INTERNAL COMBUSTION ENGINE

(75) Inventors: Shinichi Takemura, Yokohama (JP); Takanobu Sugiyama, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 226 days.

(21) Appl. No.: 09/873,399

(22) Filed: Jun. 5, 2001

(65) Prior Publication Data

US 2002/0108592 A1 Aug. 15, 2002

(30) Foreign Application Priority Data

Jun. 9, 2000 (JP) ..... 2000-173127

(51) Int. Cl.[7] ..... F01L 1/34

(52) U.S. Cl. ..... 123/90.15; 123/90.12; 123/90.17; 123/90.27; 123/90.31

(58) Field of Search ..... 123/90.27, 90.31, 123/90.11, 90.12, 90.13, 90.15, 90.16, 90.18, 90.17

(56) References Cited

U.S. PATENT DOCUMENTS

| | | | | | |
|---|---|---|---|---|---|
| 5,103,780 | A | * | 4/1992 | Ishii | 123/90.15 |
| 5,357,915 | A | | 10/1994 | Yamamoto et al. | |
| 5,357,936 | A | | 10/1994 | Hitomi et al. | |
| 5,398,502 | A | * | 3/1995 | Watanabe | 60/284 |
| 5,497,737 | A | * | 3/1996 | Nakamura | 123/90.15 |
| 5,531,193 | A | | 7/1996 | Nakamura | |
| 6,250,266 | B1 | * | 6/2001 | Okui et al. | 123/90.17 |
| 6,397,800 | B2 | * | 6/2002 | Nohara et al. | 123/90.15 |

FOREIGN PATENT DOCUMENTS

| | | | | | |
|---|---|---|---|---|---|
| DE | 43 17 748 | A1 | | 12/1993 | |
| EP | 0 640 749 | A1 | | 3/1995 | |
| EP | 0 854 273 | A1 | | 7/1998 | |
| EP | 1162350 | A2 | * | 12/2001 | F01L/13/00 |
| JP | 03064608 | A | * | 3/1991 | F01L/13/00 |
| JP | 5-332112 | | | 12/1993 | |
| JP | 06235307 | A | * | 8/1994 | F01L/1/34 |

OTHER PUBLICATIONS

Patent Abstracts of Japan, vol. 011, No. 188 (M–599), Jun. 17, 1987, JP 62–013708.

Patent Abstracts of Japan, vol. 1999, No. 03, Mar. 31, 1999, JP 10–318001.

* cited by examiner

*Primary Examiner*—Thomas Denion
*Assistant Examiner*—Ching Chang
(74) *Attorney, Agent, or Firm*—Foley & Lardner

(57) ABSTRACT

To an internal combustion engine having intake and exhaust valves, there is applied a variable valve timing device. The timing device comprises a first mechanism which varies a working angle of the intake valve within a first given range from a minimum working angle to a maximum working angle; a second mechanism which varies an operation phase of the exhaust valve within a second given range from a most retarded phase to a most advanced phase; and a control unit which controls both the first and second mechanisms in accordance with an operation condition of the engine. The control unit is configured to carry out, when the engine is under an idle operation range, controlling the first mechanism to cause the intake valve to assume the minimum working angle, and controlling the second mechanism to cause the exhaust valve to assume the most advanced phase, and when the intake valve assumes the minimum working angle, controlling the first mechanism to set the open timing of the intake valve to a first point retarded relative to the top dead center (TDC), and when the exhaust valve assumes the most advanced phase, controlling the second mechanism to set the close timing of the exhaust valve to a second point retarded relative to the top dead center (TDC).

21 Claims, 7 Drawing Sheets

VARIABLE VALVE TIMING DEVICE OF INTERNAL COMBUSTION ENGINE

BACKGROUND OF INVENTION

1. Field of Invention

The present invention relates in general to control devices for controlling internal combustion engines, and more particularly to valve control devices of a timing-variable type that, for achieving desired operation of the engine throughout entire operation range, controls the timing of intake and/or exhaust valves in accordance with operation condition of the engine. More specifically, the present invention is concerned with improvement of such variable valve control devices, by which the working angle and the operation phase of intake and/or exhaust valves are varied or controlled in accordance with the engine operation condition.

2. Description of Prior Art

Hitherto, various types of valve control devices have been proposed and put into practical use in the field of automotive internal combustion engines. Among them, there is a timing-variable type that can vary or control the working angle and the operation phase of the intake and/or exhaust valve, so as to obtain improved fuel economy and driveability especially in a low-speed and low-load operation range of the engine, and obtain sufficient engine output especially in a high-speed and high-load operation range by practically using the advantage of increased mixture charging effect at the intake stroke.

It is now to be noted that the term "working angle" used in the following description corresponds to the open period of the corresponding valve or valves and is represented by an angular range (viz., crankangle) of the engine crankshaft and, the term "operation phase" used in the description corresponds to the operation timing of the corresponding valve or valves relative to the engine crankshaft.

SUMMARY OF THE INVENTION

In order to clarify the task of the present invention, one known variable valve timing device of the above-mentioned type will be briefly described in the following with reference to FIG. 12 of the accompanying drawings, which is described in Japanese Patent First Provisional Publication 5-332112.

As is understood from the drawing, in the variable valve timing device of the publication, there are provided both an intake valve working angle switching mechanism which can switch the working angle of the intake valve to either one of a low-speed working angle (a) and a high-speed working angle (b) and an exhaust valve operation phase switching mechanism which can switch the operation phase of the exhaust valve to either one of a low-speed operation phase (c) and a high-speed operation phase (d). That is, each of the switching mechanisms has only two stages (viz., two working angles or two operation phases) for the engine speed, which tends to induce insufficient freedom in setting the valve lift characteristics. That is, when the engine is under an idle operation range or low-load operation range or low-speed and high-load operation range, the valve timing device controls the intake valve by using the low-speed working angle (a) and controls the exhaust valve by using the low-speed operation phase (c).

When the intake and exhaust valves of the engine are set to assume such low-speed working angle (a) and low-speed operation phase (c), it is necessary to reduce the valve overlap to a sufficiently small degree or to substantially zero (viz., minus valve overlap) for avoiding knocking of the engine, that is, for achieving a stable combustion of the engine. However, in the variable valve timing device of the publication, the valve open timing of the intake valve assuming the low-speed working angle (a) is set in the vicinity of the top dead center (TDC), more specifically, to a point slightly advanced relative to the top dead center (TDC). Thus, for carrying out the minus valve overlap, it is inevitably necessary to set the close timing of the exhaust valve assuming the low-speed operation phase (c) to a point advanced relative to the top dead center (TDC). While, considering effectiveness in using the piston expansion under the idle operation range, there is a limit in largely advancing the open timing of the exhaust valve. Accordingly, if, under this condition, the close timing of the exhaust valve is advanced relative to the top dead center (TDC), the working angle becomes small and thus it tends to occur that sufficient output power is not obtained at the high-speed operation range. While, if, for increasing the output power, the working angle of the exhaust valve is set to have a larger degree, the valve lift characteristics desired at the idle operation range are not obtained, which tends to deteriorate the combustion stability and fuel economy of the engine.

It is therefore an object of the present invention to provide a variable valve timing device of an internal combustion engine, which is free of the above-mentioned shortcomings.

That is, according to the present invention, there is provided a variable valve timing device of an internal combustion engine, by which under an idle operation range of the engine, the valve overlap is sufficiently reduced or made to assume a minus mode to reduce the residual gas (viz., internal EGR gas) for improving combustion stability and the working angle of the exhaust valve is sufficiently increased for increasing output of the engine under such idle operation range.

According to a first aspect of the present invention, there is provided a variable valve timing device of an internal combustion engine having intake and exhaust valves. The variable valve timing device comprises a first mechanism which varies a working angle of the intake valve within a first given range from a minimum working angle to a maximum working angle; a second mechanism which varies an operation phase of the exhaust valve within a second given range from a most retarded phase to a most advanced phase; and a control unit which controls both the first and second mechanisms in accordance with an operation condition of the engine, the control unit being configured to carry out, when the engine is under an idle operation range, controlling the first mechanism to cause the intake valve to assume the minimum working angle, and controlling the second mechanism to cause the exhaust valve to assume the most advanced phase, and when the intake valve assumes the minimum working angle, controlling the first mechanism to set the open timing of the intake valve to a first point retarded relative to the top dead center (TDC), and when the exhaust valve assumes the most advanced phase, controlling the second mechanism to set the close timing of the exhaust valve to a second point retarded relative to the top dead center (TDC).

According to a second aspect of the present invention, there is provided a variable valve timing device of an internal combustion engine having intake and exhaust valves. The variable valve timing device comprises a first mechanism which varies a working angle of the intake valve within a first given range from a minimum working angle to a maximum working angle; a second mechanism which varies an operation phase of the exhaust valve within a second given range from a most retarded phase to a most advanced phase; and a control unit which controls both the first and second mechanisms in accordance with an operation condition of the engine, the control unit being configured to carry out, when the engine is under an idle operation range, controlling the first mechanism to cause the intake valve to assume the minimum working angle while setting the open timing of the intake valve to a first point retarded relative to the top dead center (TDC), and controlling the second mechanism to cause the exhaust valve to assume the most advanced phase while setting the close timing of the exhaust valve to a second point retarded relative to the top dead center (TDC).

According to a third aspect of the present invention, there is provided a method of controlling an internal combustion engine having a first mechanism which varies a working angle of an intake valve of the engine within a first given range from a minimum working angle to a maximum working angle, and a second mechanism which varies an operation phase of an exhaust valve within a second given range from a most retarded phase to a most advanced phase. The method comprises determining whether the engine is under an idle operation range or not; and controlling, upon determination of the idle operation range, the first mechanism to cause the intake valve to assume the minimum working angle while setting the open timing of the intake valve to a first point retarded relative to the top dead center (TDC), and controlling the second mechanism to cause the exhaust valve to assume the most advanced phase while setting the close timing of the exhaust valve to a second point retarded relative to the top dead center (TDC).

DETAILED DESCRIPTION OF THE INVENTION

In the following, a variable valve timing device according to the present invention will be described in detail with reference to the accompanying drawings. For ease of understanding, various dimensional terms such as, upper, lower, right, left, upward, downward, etc., are used in the description. However, such terms are to be understood with respect to only a drawing or drawings in which the corresponding part or portion is shown.

Referring to FIGS. 1 to 11, there is shown a variable valve timing device of an internal combustion engine, which is an embodiment of the present invention. In the illustrated embodiment, the engine to which the valve timing device of the invention is practically applied has two intake valves and two exhaust valves for each cylinder.

Figure 1:
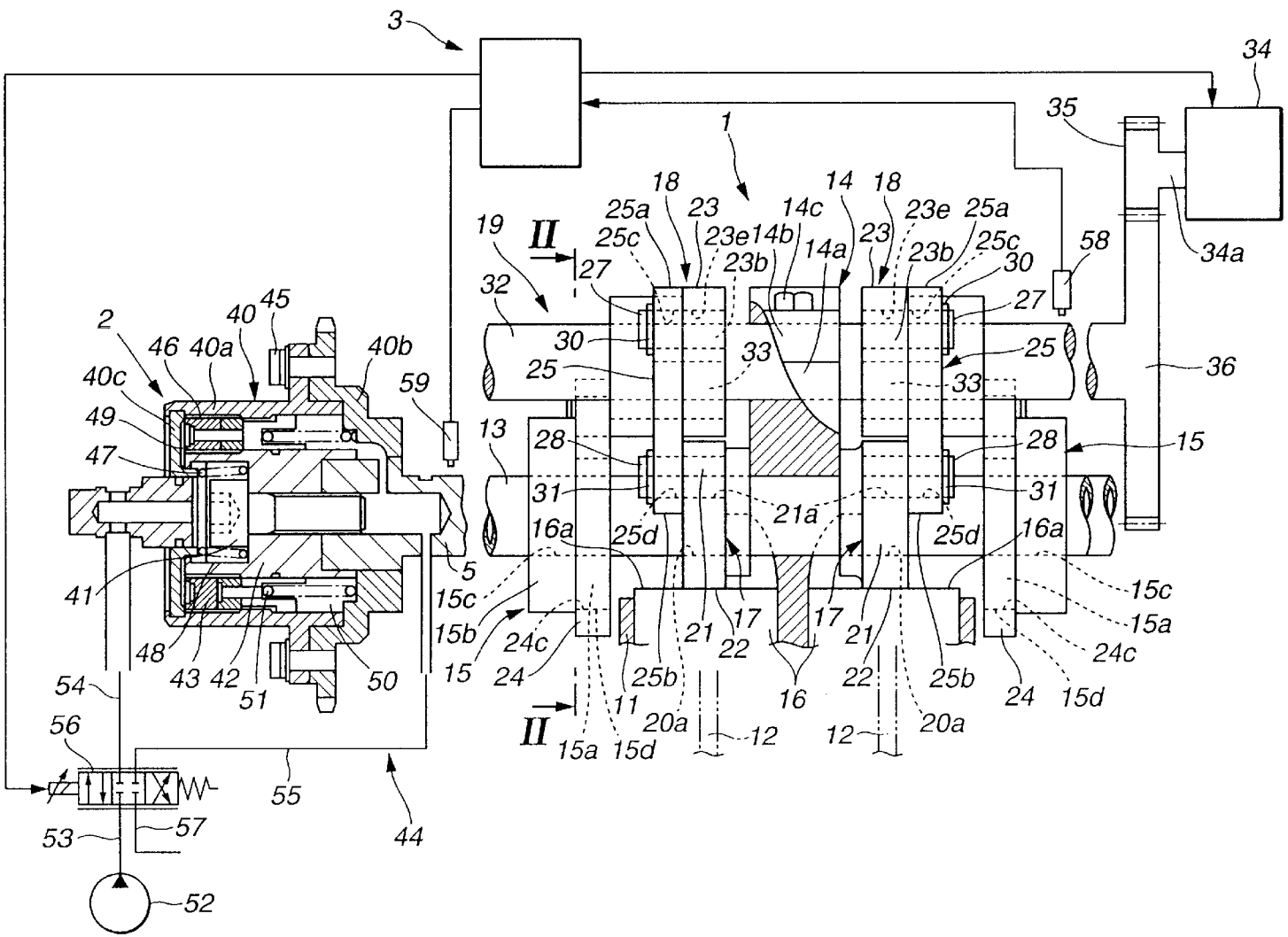
FIG. 1 is a schematic view of a variable valve timing device of an internal combustion engine, according to the present invention.

As is seen from FIG. 1, the variable valve timing device of the invention comprises an intake valve working angle varying mechanism 1 (or first mechanism) which varies or controls the working angle of each intake valve 12 within a first given range from a minimum working angle to a maximum working angle, an exhaust valve operation phase varying mechanism 2 (or second mechanism) which varies or controls the operation phase of each exhaust valve (not shown) within a second given range from a most retarded phase to a most advanced phase and a control unit 3 which controls the above-mentioned first and second mechanisms 1 and 2 in accordance with an operation condition of the engine. The engine operation condition is estimated by processing information signals issued from various sensors such as an intake valve position sensor 58, an exhaust valve position sensor 59 and the like. The control unit 3 comprises a micro-computer including generally CPU, RAM, ROM and input and output interfaces.

Figure 2:
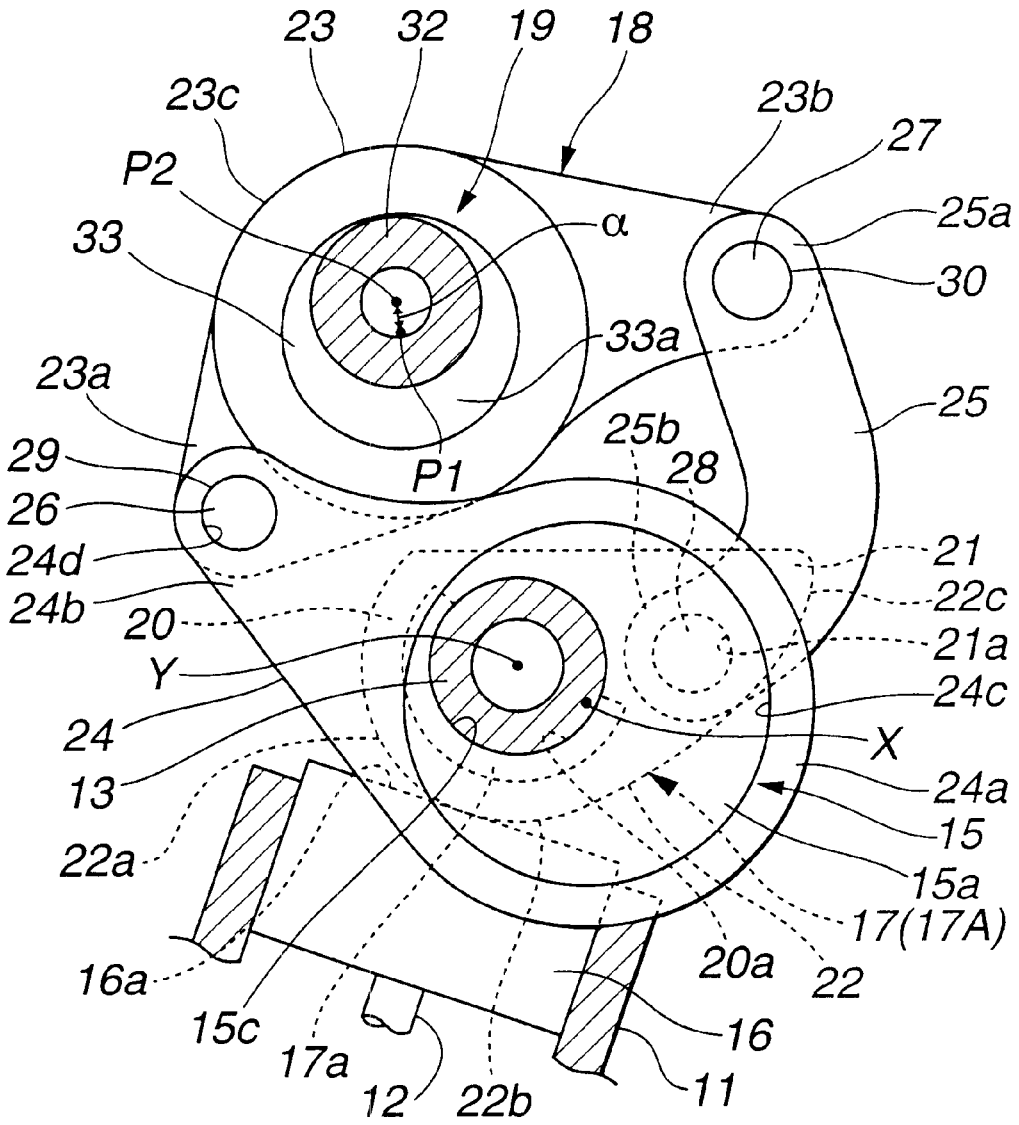
FIG. 2 is an enlarged sectional view of the variable valve timing device taken along the line II—II of FIG. 1, showing an intake valve working angle varying mechanism.
Figure 3:
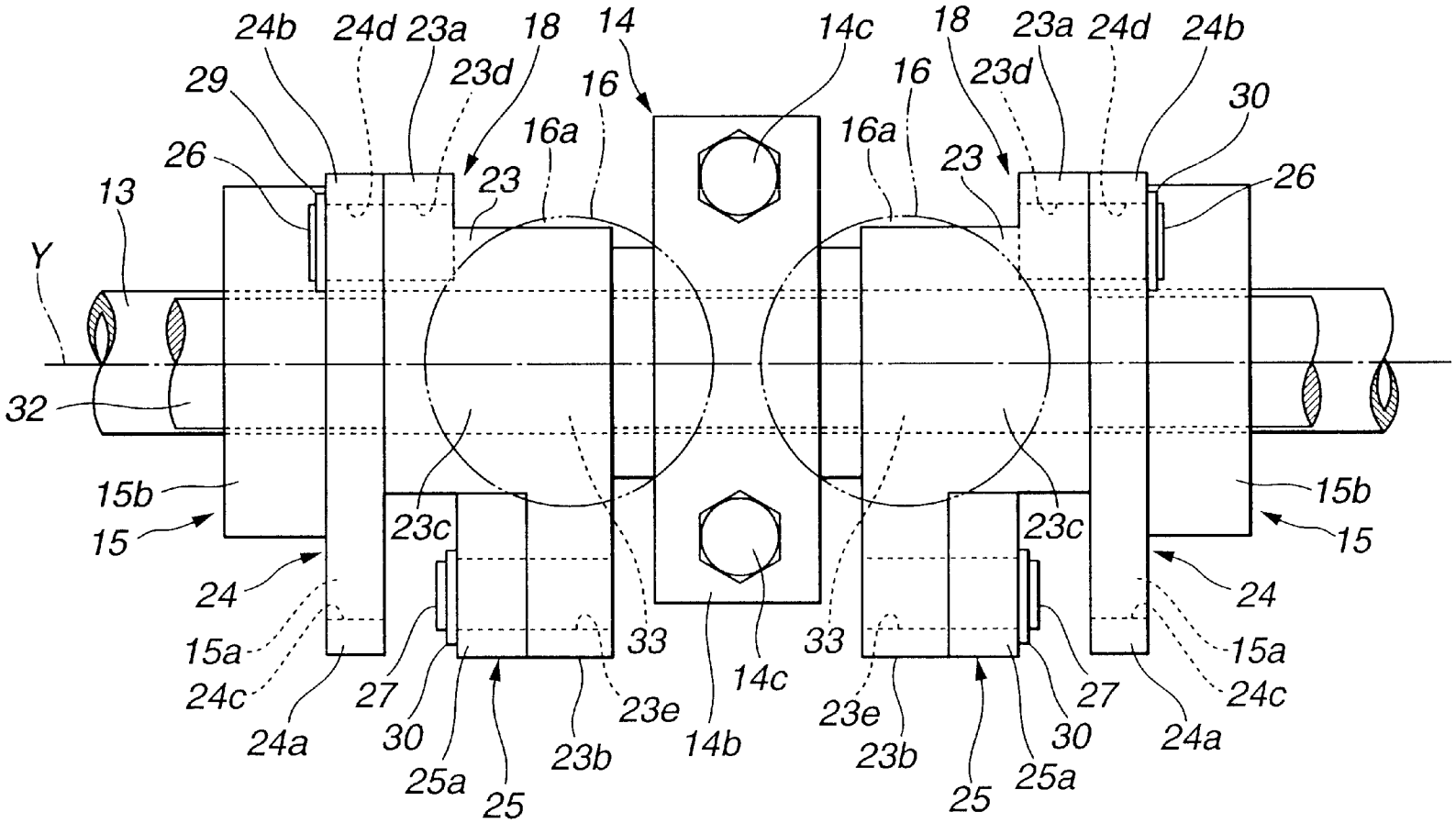
FIG. 3 is an enlarged top view of the variable valve timing device, showing the intake valve working angle varying mechanism.

As is seen from FIGS. 1 to 3, the first mechanism 1 comprises a hollow drive shaft 13 that is rotatably supported on an upper portion of a cylinder head 11 through bearings 14 (only one is shown). To the drive shaft 13, there is transmitted a torque of a crankshaft through a pulley (or sprocket) and a chain (or timing belt), so that the drive shaft 13 operates synchronously with the crankshaft. Around the drive shaft 13, there are pivotally disposed two swing cams 17 for each cylinder. Under operation of the engine, the two swing cams 17 push flat upper surfaces 16*a* of two valve lifters 16 arranged at upper ends of the two intake valves 12 thereby to induce an open movement of the intake valves 12.

As will become apparent as the description proceeds, due to the work of the first mechanism 1, the angularly positional relation between the drive shaft 13 and each of the swing cams 17 is changeable. With this, under operation of the engine, an after-mentioned link mechanism between the drive shaft 13 and each swing cam 17 is subjected to a posture change, so that the working angle of the intake valves 12 is continuously varied.

The first mechanism 1 further comprises two eccentric drive cams 15 which are tightly disposed on the drive shaft 13 to rotate therewith, two ring-shaped links 24 which are rotatably disposed about the eccentric drive cams 15 respectively, a control shaft 32 which extends in parallel with the drive shaft 13, two eccentric control cams 33 which are tightly disposed on the control shaft 32 to rotate therewith, two rocker arms 23 which are rotatably disposed about the control cams 33 and pivotally connected to leading ends of the ring-shaped links 24, and two rod-shaped links 25 which pivotally connect the other ends of the rocker arms 23 to leading ends of the swing cams 17 respectively.

As shown in FIG. 1, the bearing 14 comprises a main bracket part 14*a* which is mounted on the cylinder head 11 to rotatably support the drive shaft 13, and a sub-bracket part 14*b* which is mounted on the main bracket part 14*a* to rotatably support the control shaft 32. The two bracket parts 14*a* and 14*b* are joined together and secured to the cylinder head 11 by means of two bolts 14*c*.

As is seen from FIGS. 2 and 3, each eccentric drive cam 15 comprises a ring-shaped cam portion 15*a* and a cylindrical portion 15*b* which is integrally formed on one side surface of the cam portion 15*a*. The drive cam 15 has an axially extending bore 15*c* into which the drive shaft 13 is press fitted. As is seen from FIG. 2, the shaft center "X" of the cam portion 15*a* is offset from the shaft center "Y" of the drive shaft 13 in a radial direction by a given degree. Due to securing between the drive shaft 13 and the drive cams 15, they rotate together like a single unit.

As is seen from FIG. 3, the two drive cams 15 are secured to the drive shaft 13 at such positions as not interfere with the valve lifters 16, and as is seen from FIG. 1, the cam portions 15*a* of the drive cams 15 have on their peripheral surfaces 15*d* identical cam profiles.

As is seen from FIG. 2, each swing cam 17 is formed at one side surface thereof with a generally U-shaped journal portion 17*a*. Furthermore, each swing cam 17 has an annular base portion 20 which has an opening 20*a* through which the drive shaft 13 is rotatably passed. A cam nose portion 21 integrally projected from the annular base portion 20 is formed with a pin hole 21*a*. As is seen from FIG. 2, each swing cam 17 has at its lower periphery a cam surface 22 which comprises a basic semicircular surface 22*a* which is defined by the annular base portion 20, a swollen surface 22*b* which extends from the basic semicircular surface 22*a* toward the cam nose portion 21 and a lifting surface 22*c* which is positioned at the leading end of the swollen surface 22*b*. These three surfaces 22*a*, 22*b* and 22*c* of the cam surface 22 are brought into a slidable contact with the flat upper surface 16*a* of the corresponding valve lifter 16.

As is seen from FIGS. 2 and 3, each rocker arm 23 is shaped like a bell crank, having at a center thereof a tubular base portion 23*c* which is rotatably disposed on the corresponding control cam 33. As is seen from FIG. 3, in an end portion 23*a* axially outwardly extending from the tubular bas portion 23*c* of each rocker arm 23, there is formed a pin hole 23*d* for putting therein a pin 26 which is pivotally connected to the corresponding ring-shaped link 24. While, in the other end portion 23*b* axially inwardly extending from the tubular base portion 23*c* of each rocker arm 23, there is formed another pin hole 23*e* for putting therein another pin 27 which is pivotally connected to one end portion 25*a* of the corresponding rod-shaped link 25.

As is seen from FIG. 2, each ring-shaped link 24 comprises a larger annular base portion 24*a* and a projected portion 24*b* which projects radially outward from the base portion 24*a*. In a center part of the base portion 24*a*, there is formed an opening 24*c* which rotatably bears a cylindrical outer surface of the cam portion 15*a* of the corresponding drive cam 15. While, in the projected portion 24*b*, there is formed a pin hole 24*d* for rotatably receiving therein the pin 26.

As is seen from FIG. 2, each rod-shaped link 25 is shaped like a bell crank, having both ends 25*a* and 25*b*. These ends 25*a* and 25*b* have respective pin holes 25*c* and 25*d* for putting therein respective pins 27 and 28 which are mated with the pin holes 23*e* of the other end 23*b* of the corresponding rocker arm 23 and the pin hole 21*a* of the cam nose portion 21 of the corresponding swing cam 17 respectively. The rod-shaped link 25 functions to control the maximum swing range of the swing cam 17 within a swing range of the rocker arm 23.

On one end portion of each pin 26, 27 or 28, there is disposed a snap ring 29, 30 or 31 for restraining an axial movement of the ring-shaped link 24 or the rod-shaped link 25.

The rocker arms 23, the ring-shaped links 24 and the rod-shaped links 25 constitute a transmission mechanism 18 which transmits a torque from the drive shaft 13 to the swing cams 17. The control shaft 32, the eccentric control cams 33 and an actuator 34 (see FIG. 1) constitute a control mechanism 19. The actuator 34 rotates the drive shaft 13 within a given rotation angle and keeps the drive shaft 13 at a desired angle.

The control shaft 32 extends in parallel with the drive shaft 13, and as has been mentioned hereinabove, the control shaft 32 is rotatably held between a bearing groove of an upper portion of the main bracket part 14*a* of the bearing 14 and the sub-bracket part 14*b* of the bearing 14. Each control cam 33 is cylindrical in shape, and as is seen from FIG. 2, the shaft center "P1" of the control cam 33 is offset from the shaft center "P2" of the control shaft 32 by a degree "$\alpha$". The control cams 33 and the control shaft 32 rotate together like a single unit.

As is seen from FIG. 1, the actuator 34 drives or controls the control shaft 32 through first and second spur gears 35 and 36 in accordance with an instruction signal issued from the control unit 3 that detects the operation condition of the engine. In the illustrated embodiment, the actuator 34 is of an electric type. However, if desired, the actuator 34 may be of a hydraulic type.

When, with the above-mentioned arrangement, the drive shaft 13 is rotated synchronously with the crankshaft, the ring-shaped links 24 are rotated through the eccentric drive cams 15, and at the same time, the rocker arms 23 are swung about the shaft center "P1" of the control cams 33 swinging the swing cams 17 through the rod-shaped links 25. With this, the intake valves 12 are subjected to open/close operation.

The actuator 34 is controlled in accordance with the engine operation condition, and thus the angular position of the control shaft 32 is changed. With this, the position of the shaft center "P1" of the control cams 33 about which the rod-shaped links 26 pivot is changed, changing the posture of the transmission mechanism 18. With this, the working angle (and valve lift degree) of each intake valve 12 is continuously varied keeping the operation phase of the intake valve 12 at a constant level.

As is described hereinabove, in the first mechanism 1, the mutually contacting portions between the drive cams 15 and ring-shaped links 24 and those between the control cams 33 and the rocker arms 23 constitute a so-called face-to-face contacting, and thus, lubrication is easily carried out and durability and reliability are assured, and further more, a resistance inevitably produced when switching is made is lowered. Furthermore, since the swing cams 17 are disposed about the drive shaft 13, precise movement of the swing cams 17 and compact structure are obtained as compared with a case wherein the swing cams 17 are disposed about another shaft.

Furthermore, since the working angle of each intake valve 12 can be held at a desired degree within a range from a minimum working angle "I1" to a maximum working angle "I5" which will be described hereinafter, the control of the first mechanism 1 has a higher freedom.

In the following, the second mechanism 2 will be described with reference to FIG. 1.

The second mechanism 2 is arranged in a power transmission train provided between an exhaust cam shaft 5 which actuates the exhaust valves (not shown) and a timing sprocket 40 to which a torque of the engine crankshaft is transmitted through a timing chain (not shown). That is, the second mechanism 2 functions to vary the valve timing, more specifically, the operation phase of the exhaust valves by changing relative angular positions of the cam shaft 5 and the timing sprocket 40.

The second mechanism 2 comprises a sleeve 42 which is coaxially secured to a leading end of the cam shaft 5 through bolts 41, a tubular body 40*a* which is integrally provided by the timing sprocket 40, a tubular gear 43 which is meshed with the sleeve 42 and the tubular body 40*a* through a helical spline, and a hydraulic circuit 44 which drives the tubular gear 43 toward and away from the exhaust cam shaft 5.

To a rear end of the tubular body 40*a* of the timing sprocket 40, there is connected through bolts 45 a sprocket member 40*b* on which the timing chain is put. To an open front end of the tubular body 40*a*, there is fixed a front cover 40*c* to close the open front end. The tubular body 40*a* has on its inner cylindrical surface a helical internal gear 46.

The sleeve 42 is formed at its rear side with an engaging groove with which the leading end of the exhaust cam shaft 5 is engaged. In a holding groove formed in a front side of the sleeve 42, there is installed a coil spring 47 which biases the timing sprocket 40 forward through the front cover 40*c*. The sleeve 42 has on its outer cylindrical surface a helical external gear 48 engaged with the tubular gear 43.

For avoiding undesired backlash, the tubular gear 43 is of a split member, including front and rear parts which are biased toward each other by means of pins and springs. Cylindrical outer and inner surfaces of the tubular gear 43 are formed with external and internal helical gears which are engaged with the above-mentioned internal and external gears 46 and 48. Before and after the tubular gear 43, there are defined first and second hydraulic chambers 49 and 50. Thus, by applying a hydraulic pressure to these chambers 49 and 50, the tubular gear 43 is forced to move forward or rearward while keeping the meshed engagement with the timing sprocket 40 and the sleeve 42.

The hydraulic circuit 44 comprises an oil pump 52 connected to an oil pan (not shown), a main gallery 53 connected to a downstream side of the oil pump 52, first and second hydraulic passages 54 and 55 branched from a downstream end of the main gallery 53 and connected to the first and second hydraulic chambers 49 and 50 respectively, a solenoid type switching valve 56 arranged at the branched portion of the main gallery 53 and a drain passage 57 extending from the switching valve 56.

The switching valve 56 is controlled by the control unit 3 in ON/OFF manner (viz., duty control). That is, upon receiving instruction signal from the control unit 3, the switching valve 56 assumes three positions which will be described hereinafter. That is, by changing the duty ratio of the instruction signal in accordance with the engine operation condition, the operation phase of the exhaust valves can be continuously changed within a predetermined control range and can be kept at a desired degree.

That is, when a spool of the switching valve 56 is moved to the rightmost position in FIG. 1, the first hydraulic chamber 49 is fed with a hydraulic pressure and the oil in the second hydraulic chamber 50 is drained. With this, the tubular gear 43 is shifted to a frontmost position abutting against the front cover 40*c*, and thus, the operation of the exhaust valves assumes a most advanced phase.

While, when the spool of the switching valve 56 is moved to the leftmost position in FIG. 1, the oil in the first hydraulic chamber 49 is drained and the second hydraulic chamber 50 is fed with a hydraulic pressure. With this, the tubular gear 43 is shifted to a rearmost position and thus the operation of the exhaust valves assumes a most retarded phase.

When the operation phase of the exhaust valves is in a desired degree, the spool of the switching valve 56 assumes a neutral position. In this case, both the first and second hydraulic chambers 49 and 50 are fed with a certain hydraulic pressure keeping the exhaust cam shaft 5 at a certain rotation phase.

The second mechanism 2 having the above-mentioned construction is assembled compact in size and thus easily mounted on an engine. Furthermore, the second mechanism 2 can be independently arranged with the above-mentioned first mechanism 1.

Furthermore, since the operation phase of the exhaust valves can be kept at a desired degree within a range from a most advanced phase "E1" to a most retarded phase "E3" which will be described hereinafter, the control of the second mechanism 2 has a higher freedom.

Into the control unit 3, there are inputted various information signals, which are a signal issued from the intake valve position sensor 58 and representing an angular position of the control shaft 32, a signal issued from the exhaust valve position sensor 59 and representing an angular position of the exhaust cam shaft 5, a signal issued from a crank angle sensor and representing the operation speed of the engine, a signal issued from an air flow meter and representing the amount of intake air (viz., load), a signal issued from an engine cooling water temperature sensor and representing the temperature of the engine cooling water, a signal representing an elapsed time from engine starting, etc.,. By processing these information signals, the control unit 3 issues instruction signals to the actuator 34 and the switching valve 56, so that the working angle of the intake valves 12 and the operation phase of the exhaust valves are controlled in accordance with the operation condition of the engine.

That is, by processing such information signals, the control unit 3 determines a target valve lift characteristic of the intake valves 12, that is, a target angular position of the control shaft 32, and controls the actuator 34 in accordance with the determined target valve lift characteristic. With this, the control cams 33 on the control shaft 32 are swung to their desired angular position and held in the position. Preferably, the actual angular position of the control shaft 32 is monitored by the intake valve position sensor 58, so that a feedback control is carried out so as to permit the control shaft 32 to assume a desired operation phase.

Furthermore, by processing the information signals, the control unit 3 determines a target operation phase of the exhaust valves, and controls the switching valve 56 in accordance with the determined target operation phase. With this, the tubular gear 43 is axially shifted varying the relative rotational angle between the timing sprocket 40 and the exhaust cam shaft 5. Also, in this case, it is preferable to monitor the actual angular position of the exhaust cam shaft 5 with the exhaust valve position sensor 59 for carrying out a feedback control by which the exhaust cam shaft 5 has a desired phase.

Figure 4:
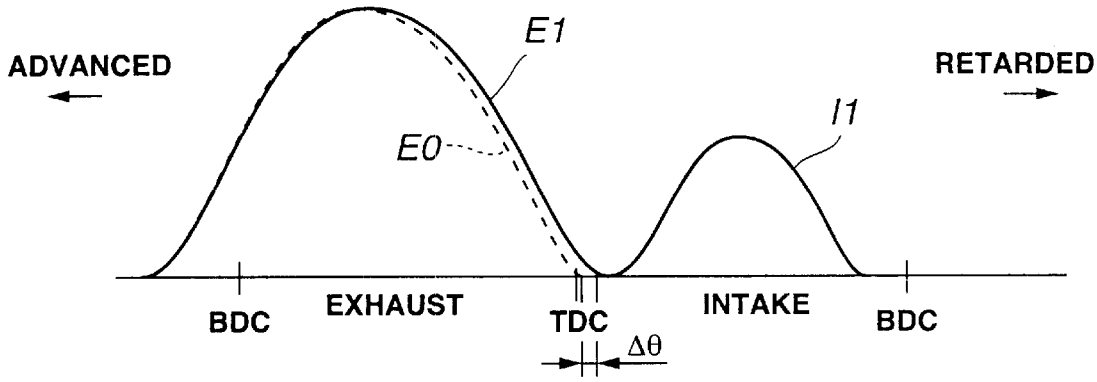
FIG. 4 is a graph showing the valve lift characteristics at an idle operation range of the engine.

FIG. 4 shows the valve lift characteristics of the intake and exhaust valves when the engine is under an idle range. Under this idle range, the working angle of the intake valves is controlled to assume the minimum working angle "I1", and the open timing of the intake valves is set to a first point which is retarded relative to the top dead center (TDC) by a predetermined degree, that is, for example, over 20 degrees and the close timing of the intake valves is set to a point which is advanced relative to the bottom dead center (BDC). While, in such idle range, the operation phase of the exhaust valves is controlled to assume the most advanced phase "E1" and the close timing of the exhaust valves is set to a second point which is retarded relative to the top dead center (TDC) by a predetermined degree, that is, for example, over 20 degrees, but advanced relative to the above-mentioned first point of the open timing of the intake valves (viz., minus valve overlap).

As is described hereinabove, in the idle operation range, the working angle of the intake valves and the valve lift degree of the same show their minimum degrees. Thus, friction is reduced and stable combustion is obtained due to improved gas flow. Furthermore, since the open timing of the intake valves is set to a point retarded relative to the top dead center (TDC) inducing the minus valve overlap, the amount of residual gas (viz., internal EGR gas) is reduced and the period for which the piston crown is exposed to the intake vacuum is shortened thereby lowering the pumping loss. Furthermore, since the close timing of the intake valves is set to a point advanced relative to the bottom dead center (BDC), the effective compression ratio appearing in the vicinity of the bottom dead center (BDC) is increased, which improves the combustibility of the air/fuel mixture led into the combustion chamber.

Figure 12:
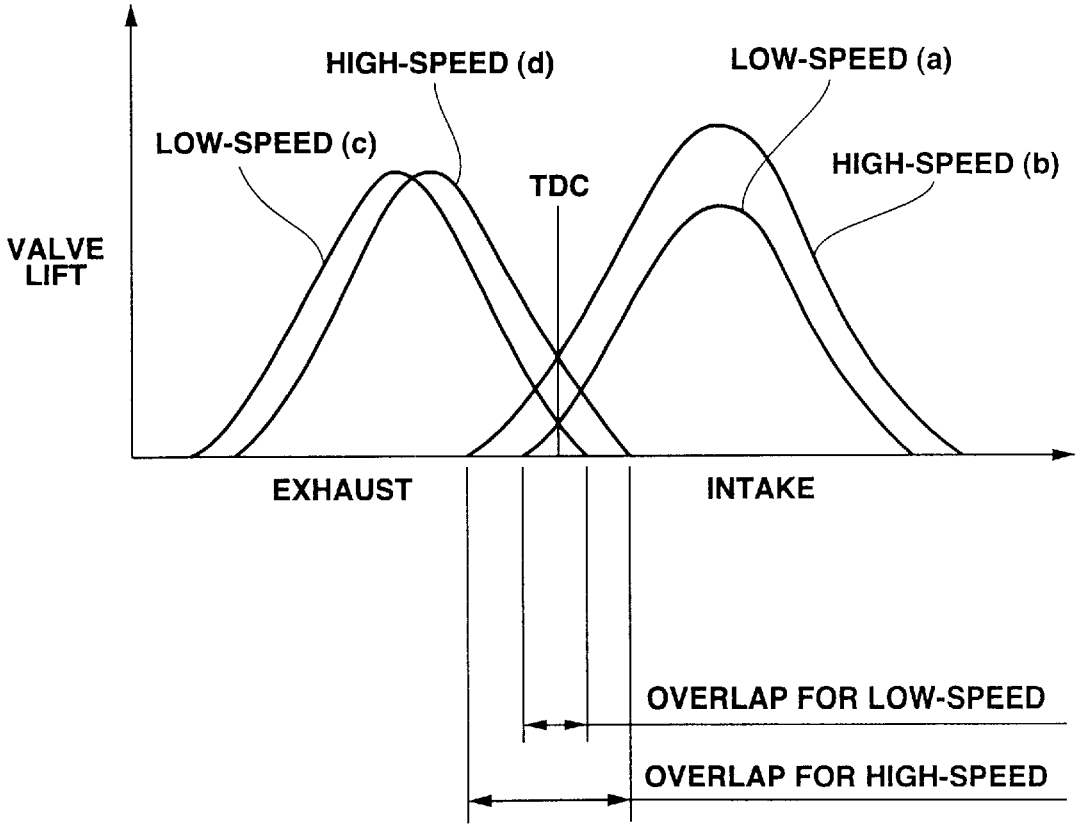
FIG.12 (RELATED ART)
FIG. 12 is a graph showing the valve lift characteristics possessed by a known variable valve timing device.
Figure 11:
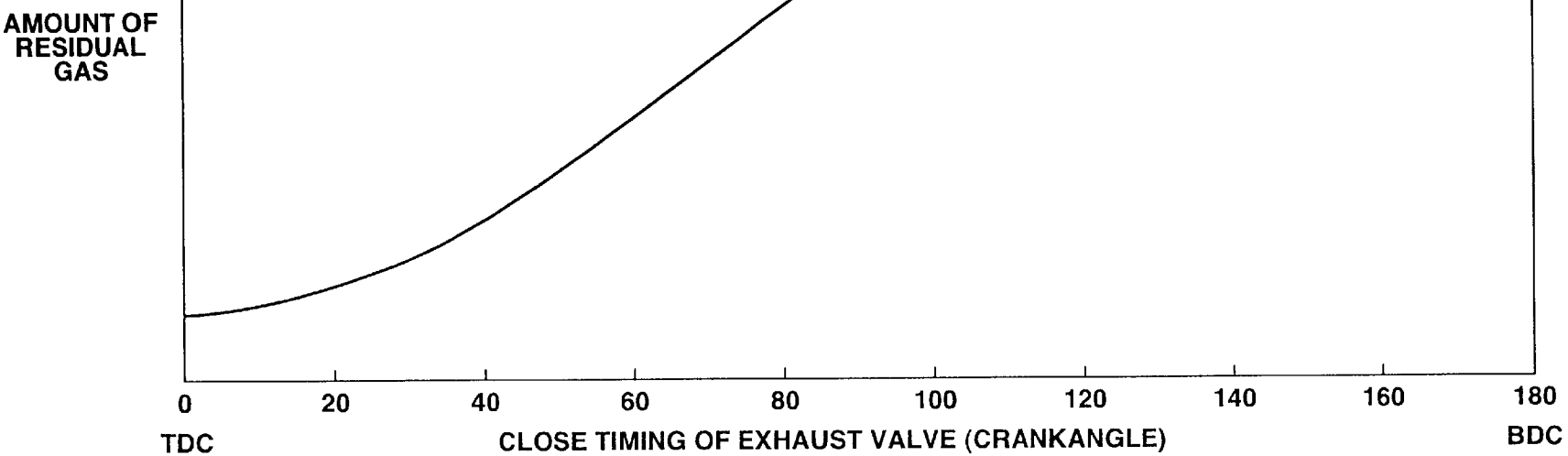
FIG. 11 is a graph showing a relationship between the close timing of the exhaust valve and the amount of residual gas.

As is known, for effective usage of the piston expansion work, the open timing of the exhaust valves can not be excessively advanced under the idle operation range. In case of an ordinary plus valve overlap (see FIG. 12), for controlling the residual gas (viz., internal EGR gas), it is preferable to set the close timing of the exhaust valves at or near a point of the top dead center (TDC) as is indicated by the waveform "E0" of the graph of FIG. 4. While, in case of the minus valve overlap according to the present invention, the residual gas confined in the combustion chambers is notable although the residual gas caused by the internal EGR is substantially zero. However, as is seen from FIG. 11, when the close timing of the exhaust valves is near the top dead center (TDC), that is, in a range from the top dead center (0) to about 20 degrees after the top dead center, the amount of residual gas confined in the combustion chambers does not show a notable change because the piston stroke is very small in such range. Accordingly, even when the close timing of the exhaust valves is set at a retarded side, that is, within a range from the bottom dead center (BDC) to about 20 degrees after the bottom dead center, the amount of residual gas can be controlled to such an amount as is made when the close timing is set at the top dead center (TDC).

As is understood from the above, since, in the idle operation range, the close timing of the exhaust valves is set to a point which is retarded relative to the bottom dead center (BDC) by a given degree "$\Delta\theta$" (see FIG. 4), the working angle of the exhaust valves is enlarged accordingly. Thus, the output under a high-speed and high-load operation range can be increased as will be described hereinafter.

Figure 5:
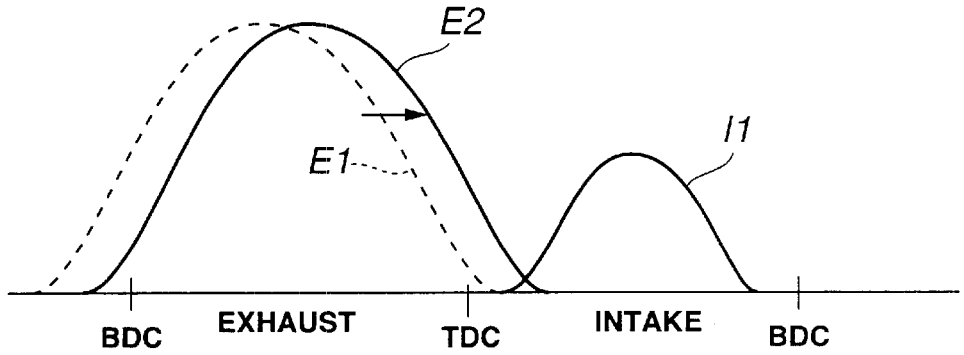
FIG. 5 is a graph showing the valve lift characteristics at the time when the engine is shifted from the idle operation range to a low-load operation range, while being applied with a load.

FIG. 5 shows the valve lift characteristics of the intake and exhaust valves when the engine is shifted from the idle operation range to a low-load operation range while being applied with a load. Under this condition, both the pumping loss and the combustion stability limit tend to increase if the minus valve overlap is maintained. Thus, for suppressing these undesirable phenomena, the operation phase of the exhaust valves is retarded from "E1" to "E2" (that is, E1→E2) keeping the working angle of the intake valves at the minimum working angle "I1". With this, the valve overlap is turned to a plus side reducing the pumping loss and improving the fuel economy. In order to increase the valve overlap degree, a measure may be thought out wherein the working angle of the intake valves is increased in place of the above-mentioned phase-retardation of the exhaust valves. However, this measure is not practical because it tends to bring about an engine stop upon speed reduction due to increase of the valve friction and back flow of the residual gas toward the intake system.

Figure 6:
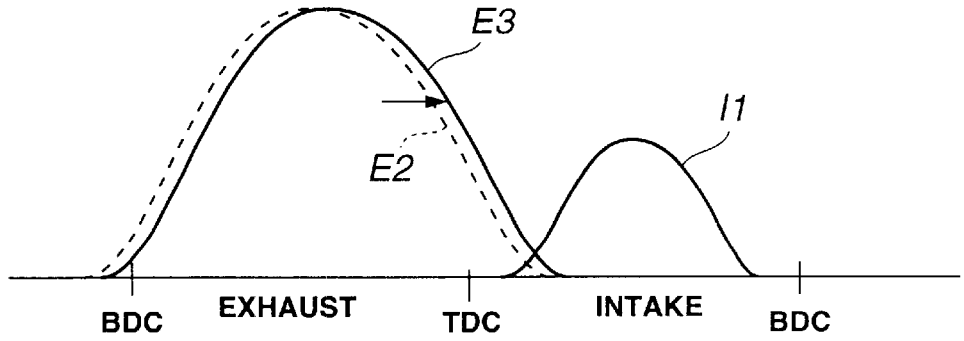
FIG. 6 is a graph showing the valve lift characteristics at the time when the engine under the low-load operation range of FIG. 5 is further applied with a load.

FIG. 6 shows the valve lift characteristics of the intake and exhaust valves when the engine under the low-load operation range represented by "I1" and "E2" of the intake and exhaust valves is further applied with a load. In this case, the operation of the exhaust valves is shifted from the phase "E2" to the most retarded phase "E3" (that is, E2→E3) in accordance with increase of load. With this, the valve overlap degree is further increased and thus further lowering of the pumping loss is achieved.

Figure 7:
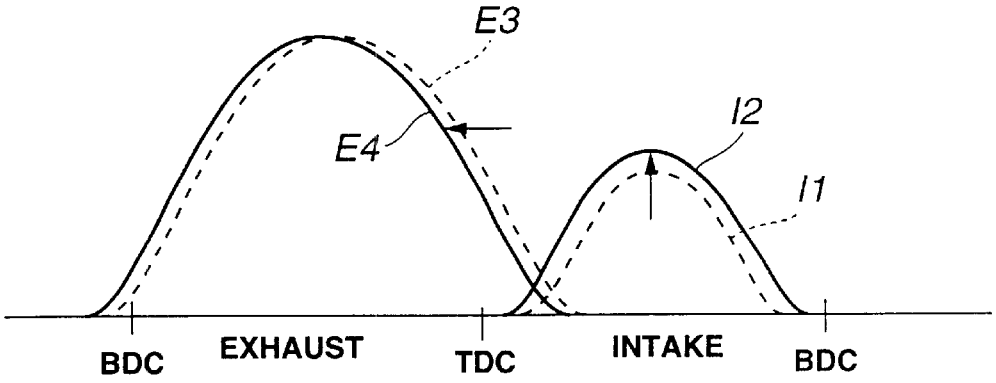
FIG. 7 is a graph showing the valve lift characteristics at the time when the engine under the condition of FIG. 6 is further applied with a load.

FIG. 7 shows the valve lift characteristics of the intake and exhaust valves when the engine under the above-mentioned condition represented by "I1" and "E3" of the intake and exhaust valves is further applied with a load. In this case, the working angle of the intake valves is increased from "I1" to "I2" (that is, I1→I2) in accordance with increase of the load. Furthermore, for avoiding a possible engine stop upon speed reduction due to excessive valve overlap and for avoiding increase of pumping loss due to minus valve overlap, the operation phase of the exhaust valves is advanced from "E3" to "E4" (that is, E3→E4). That is, the valve overlap is controlled substantially constant.

Figure 8:
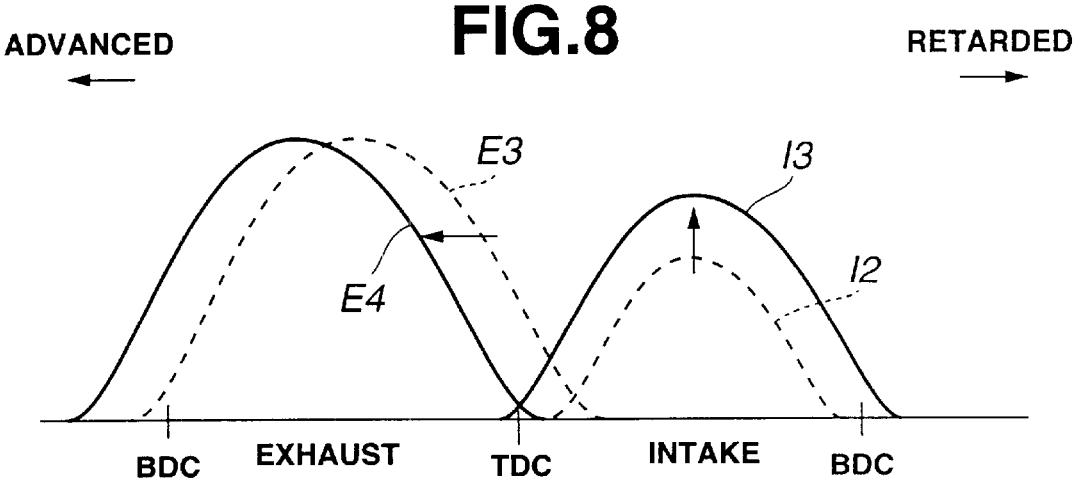
FIG. 8 is a graph showing the valve lift characteristics at the time when the engine is under a low-speed and high-load operation range.
Figure 9:
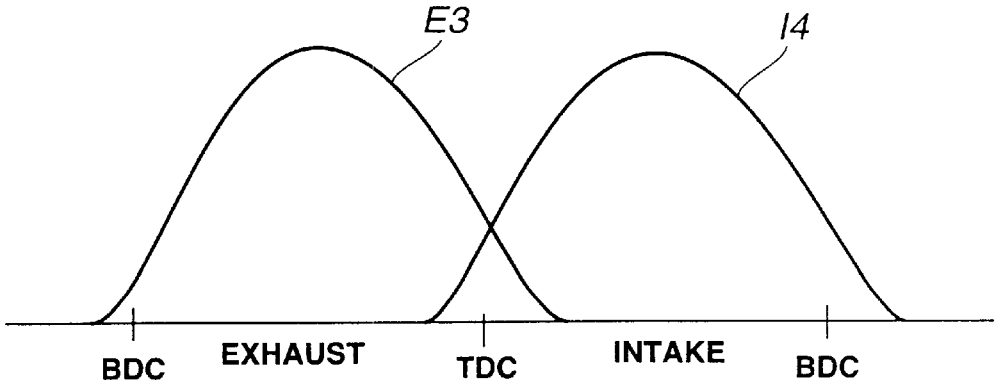
FIG. 9 is a graph showing the valve lift characteristics at the time when the engine is under a middle-speed and high-load operating range.
Figure 10:
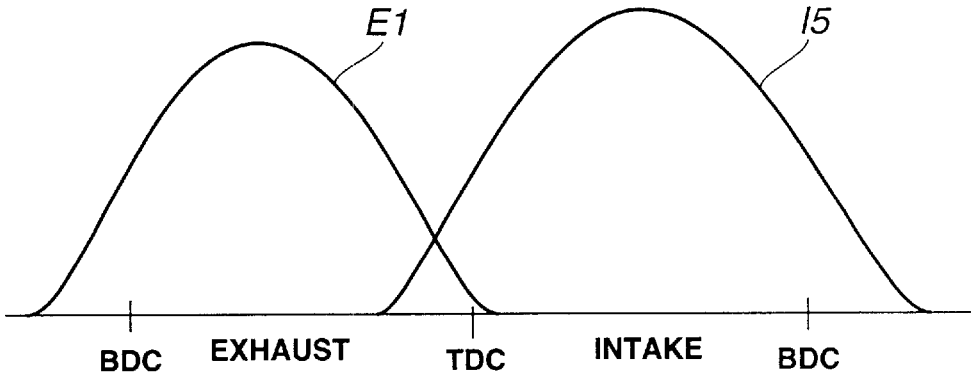
FIG. 10 is a graph showing the valve lift characteristics at the time when the engine is under a high-speed and high-load operation range.

FIGS. 8, 9 and 10 show the valve lift characteristics of the intake and exhaust valves when the engine is under a high-load operation range with different speed. That is, in this high-load operation range, the working angle of the intake valves is increased in accordance with increase of the engine speed (that is, I2→I3→I4→I5).

That is, FIG. 8 shows the valve lift characteristics of the intake and exhaust valves when the engine is under a low-speed and high-load operation range. In this range, for avoiding a possible knocking due to presence of residual gas, the working angle of the intake valves is increased to "I3" higher than "I2" which is set at the above-mentioned low-load operation range of FIG. 7, and at the same time, the operation phase of the exhaust valves is advanced from the most retarded phase "E3" to "E4". With this, the valve overlap is reduced and the central point of the valve overlap is brought to a point near the top dead center (TDC).

FIG. 9 shows the valve lift characteristics of the intake and exhaust valves when the engine is under a middle-speed and high-load operation range. In this range, the working angle of the intake valves is increased to such a degree "I4" as that of the exhaust valves and at the same time, the operation phase of the exhaust valves is retarded to or near the most retarded phase "E3". With this, as compared with the case of FIG. 8 wherein the engine is under the low-speed and high-load operation range, the valve overlap is increased, so that the scavenging effect is effectively used and thus the charging efficiency is increased.

FIG. 10 shows the valve lift characteristics of the intake and exhaust valves when the engine is under a high-speed and high-load operation range. In this range, the working angle of the intake valves is increased to the maximum working angle "I5" and thus the close timing of the intake valves is retarded. Thus, the valve lift is increased and the charging efficiency is increased. At the same time, the operation phase of the exhaust valves is advanced as compared with the operation of FIG. 9 wherein the engine is under the middle-speed and high-load operation range. More specifically, the operation phase of the exhaust valves is advanced to or near the most advanced phase "E1". With this, the exhaust discharging loss is reduced and maximum output is obtained from the engine.

It is to be noted that the working angle of the exhaust valves is set to a degree that is smaller than the maximum working angle "I5" of the intake valves that is set when the engine is under the maximum output condition, that is, under the high-speed and high-load operation range. This reason is as follows. If the working angle of the exhaust valves is set larger than the maximum working angle "I5" of the intake valves, earlier open timing of the exhaust valves takes place, which tends to induce a poor fuel economy under the idle operation range. Furthermore, the working angle of the exhaust valves is set to a degree that is larger than each of the working angles "I1", "I2" and "I3" of the intake valves, which are set when the engine is under the idle operation range, low-load operation range and low-speed and high-load operation range respectively. This reason is as follows. That is, if the working angle of the exhaust valves is set smaller than the working angle "I1" of the intake valves in the idle operation range, the open timing of the exhaust valves is brought to a point retarded relative to the bottom dead center (BDC), so that the pumping loss is increased bringing about a poor fuel economy and lowering of the output performance of the engine. That is, the working angle of the intake valves is set smaller than that of the exhaust valves under the idle operation range but larger than that of the exhaust valves under the high-speed and high-load operation range.

The entire contents of Japanese Patent Application 2000-173127 (filed Jun. 9, 2000) are incorporated herein by reference.

Although the invention has been described above with reference to the embodiment of the invention, the invention is not limited to such embodiment as described above. Various modifications and variations of such embodiment may be carried out by those skilled in the art, in light of the above descriptions.

What is claimed is:

1. A variable valve timing device of an internal combustion engine having intake and exhaust valves, comprising:

a first mechanism which varies a working angle of the intake valve within a first given range from a minimum working angle to a maximum working angle;

a second mechanism which varies an operation phase of the exhaust valve within a second given range from a most retarded phase to a most advanced phase; and a control unit which controls both said first and second mechanisms in accordance with an operation condition of the engine, said control unit being configured to carry out:

when the engine is under an idle operation range, controlling said first mechanism to cause said intake valve to assume said minimum working angle, and controlling said second mechanism to cause said exhaust valve to assume said most advanced phase, and when said intake valve assumes said minimum working angle, controlling said first mechanism to set the open timing of said intake valve to a first point retarded relative to the top dead center (TDC), and when said exhaust valve assumes said most advanced phase, controlling said second mechanism to set the close timing of the exhaust valve to a second point retarded relative to the top dead center (TDC).

2. A variable valve timing device as claimed in claim 1, in which said control unit is configured to carry out:

when said engine is shifted from the idle operation range to a low-load operation range while being applied with a load, controlling said second mechanism to cause said exhaust valve to be retarded.

3. A variable valve timing device as claimed in claim 1, in which said control unit is configured to carry out:

when the engine is under a first controlled condition wherein said intake valve assumes said minimum operation angle and said exhaust valve assumes said most retarded phase, controlling said second and first mechanisms to cause the close timing of said exhaust valve to be retarded relative to the open timing of said intake valve for providing a predetermined valve overlap between the intake and exhaust valves.

4. A variable valve timing device as claimed in claim 3, in which said control unit is configured to carry out:

when the engine is shifted from said first control condition to a condition wherein the operation angle of said intake valve is increased, controlling said second mechanism to cause the operation phase of said exhaust valve to be advanced for keeping said valve overlap at a constant value.

5. A variable valve timing device as claimed in claim 1, in which said control unit is configured to carry out:

when the engine is under the idle operation range or the low-load operation range, controlling said first mechanism to cause the working angle of said intake valve to or near the minimum working angle, and when the engine is under a high-load operation range, controlling said first mechanism to increase the working angle of said intake valve in accordance with increase of the engine speed.

6. A variable valve timing device as claimed in claim 1, in which said control unit is configured to carry out:

when the engine is under the idle operation range, controlling said first mechanism to make the working angle of said intake valve smaller than that of said exhaust valve, and when the engine is under a high-speed and high-load operation, controlling said first mechanism to make the working angle of said intake vale larger than that of said exhaust valve.

7. A variable valve timing device as claimed in claim 1, in which said control unit is configured to carry out:

when the engine is under a high-speed and high-load operation range, controlling said second mechanism to cause the exhaust valve to assume an operation phase advanced as compared with that assumed when the engine is under a middle-speed and high-load operation range.

8. A variable valve timing device as claimed in claim 1, in which said first mechanism is constructed to hold the working angle of the intake valve at a desired degree within said first given range.

9. A variable valve timing device as claimed in claim 1, in which said second mechanism is constructed to hold the operation phase of the exhaust valve at a desired degree within said second given range.

10. A variable valve timing device of an internal combustion engine having intake and exhaust valves, comprising:

a first mechanism which varies a working angle of the intake valve within a first given range from a minimum working angle to a maximum working angle;

a second mechanism which varies an operation phase of the exhaust valve within a second given range from a most retarded phase to a most advanced phase; and a control unit which controls both said first and second mechanisms in accordance with an operation condition of the engine, said control unit being configured to carry out:

when the engine is under an idle operation range, controlling said first mechanism to cause said intake valve to assume said minimum working angle while setting the open timing of said intake valve to a first point retarded relative to the top dead center (TDC); and controlling said second mechanism to cause said exhaust valve to assume said most advanced phase while setting the close timing of the exhaust valve to a second point retarded relative the top dead center (TDC).

11. A variable valve timing device as claimed in claim 10, in which the close timing of said intake valve is set to a third point advanced relative to the bottom dead center (BDC) and said second point is advanced relative to said first point.

12. A variable valve timing device as claimed in claim 10, in which said control unit is configured to carry out:

when the engine is shifted from the idle operation range to a low-load operation range while being applied with a load, controlling said second mechanism to retard the operation phase of said exhaust valve with respect to said most advanced phase.

13. A variable valve timing device as claimed in claim 12, in which said control unit is configured to carry out:

when the engine under said low-load operation range is further applied with a load to assume a first condition, controlling said second mechanism to retard the operation phase of said exhaust valve to the most retarded phase in accordance with increase of the load thereby to increase a valve overlap.

14. A variable valve timing device as claimed in claim 13, in which said control unit is configured to carry out:

when the engine assuming said first condition is further applied with a load, controlling said first mechanism to increase the working angle of said intake valve in accordance with increase of the load; and controlling said second mechanism to advance the operation phase of said exhaust valve to provide a constant valve overlap.

15. A variable valve timing device as claimed in claim 10, in which said control unit is configured to carry out:

when said engine is under the idle operation range or a low-load operation range, controlling said first mechanism to set the working angle of said intake valve to or near the minimum working angle; and when the engine is under a high-load operation range, controlling said first mechanism to increase the working angle of the intake valve in accordance with increase of the engine speed.

16. A variable valve timing device as claimed in claim 10, in which said control unit is configured to carry out:

when the engine is under the idle operation range, controlling said first mechanism to make the working angle of said intake valve smaller than that of said exhaust valve; and when the engine is under a high-speed and high-load operation range, controlling said first mechanism to make the working angle of said intake valve larger than that of said exhaust valve.

17. A variable valve timing device as claimed in claim 10, in which said control unit is configured to carry out:

when the engine is under a low-speed and high-load operation range, controlling said first mechanism to make the working angle of said intake valve larger than that set when the engine is under a low-load operation range; and controlling said second mechanism to advance the operation phase of said exhaust valve relative to said most retarded phase.

18. A variable valve timing device as claimed in claim 17, in which said first mechanism is controlled to set the open timing of said intake valve to a point advanced relative to the top dead center (TDC) and set the close timing of said intake valve to a point retarded relative to the bottom dead center (BDC), and in which said second mechanism is controlled to set the close timing of said exhaust valve to a point retarded relative to the top dead center (TDC).

19. A variable valve timing device as claimed in claim 18, in which said control unit is configured to carry out:

when the engine is under a middle-speed and high-load operation range, controlling said first mechanism to increase the working angle of said intake valve to such a degree as that of said exhaust valve; and controlling said second mechanism to retard the operation phase of said exhaust valve to or near said most retarded phase.

20. A variable valve timing device as claimed in claim 19, in which said control unit is configured to carry out:

when the engine is under a high-speed and high-load operation range, controlling said first mechanism to cause said intake valve to assume said maximum working angle; and controlling said second mechanism to advance the operation phase of said exhaust valve to or near the most advanced phase.

21. In an internal combustion engine having a first mechanism which varies a working angle of an intake valve of the engine within a range from a minimum working angle to a maximum working angle, and a second mechanism which varies an operation phase of the exhaust valve within a range from a most retarded phase to a most advanced phase, a method of controlling the engine, comprising:

determining whether the engine is under an idle operation range or not; and controlling, upon determination of the idle operation range, said first mechanism to cause said intake valve to assume said minimum working angle while setting the open timing of said intake valve to a first point retarded relative to the top dead center (TDC), and controlling said second mechanism to cause said exhaust valve to assume said most advanced phase while setting the close timing of the exhaust valve to a second point retarded relative to the top dead center (TDC).

* * * * *